US006969805B2

(12) United States Patent
Lee et al.

(10) Patent No.: US 6,969,805 B2
(45) Date of Patent: Nov. 29, 2005

(54) STRUCTURE OF AUDIO SIGNAL CABLE

(76) Inventors: Chang-Chi Lee, No.58, Shi-An St., Hu-Wei Town, Yun-Lin Shian (TW); Jay Victor, No.58, Shi-An St., Hu-Wei Town, Yun-Lin Shian (TW)

( * ) Notice: Subject to any disclaimer, the term of this patent is extended or adjusted under 35 U.S.C. 154(b) by 111 days.

(21) Appl. No.: 10/619,441

(22) Filed: Jul. 16, 2003

(65) Prior Publication Data

US 2005/0011667 A1 Jan. 20, 2005

(51) Int. Cl.[7] ..... H01B 7/00
(52) U.S. Cl. ..... 174/110 R; 174/113 R; 174/115
(58) Field of Search ..... 174/36, 110 R, 174/113 R, 115, 116, 117 F, 117 FF, 114 R

(56) References Cited

U.S. PATENT DOCUMENTS 3,816,644 A * 6/1974 Giffel et al. ..... 174/115
4,628,151 A * 12/1986 Cardas ..... 174/114 R
4,777,324 A * 10/1988 Lee ..... 174/34
5,491,299 A * 2/1996 Naylor et al. ..... 174/36
5,510,578 A * 4/1996 Dunlavy ..... 174/128.1
5,516,986 A * 5/1996 Peterson et al. ..... 174/113 C
5,976,070 A * 11/1999 Ono et al. ..... 600/110
6,194,663 B1 * 2/2001 Friesen et al. ..... 174/110 R
6,388,188 B1 * 5/2002 Harrison ..... 174/27
6,495,763 B1 * 12/2002 Eichmann et al. ..... 174/113 R

* cited by examiner

*Primary Examiner*—William H. Mayo, III
(74) *Attorney, Agent, or Firm*—Trojan Law Offices

(57) ABSTRACT

An audio signal cable, the features of which are that the audio signal cable has arrayed solid and tinsel wire conductors. After each of the conductors are insulated and bundled, they are placed into a surrounding insulation. The solid conductors are of a circular and a flat, thin shape. The solid conductors are of differing larger and smaller diameters and, furthermore, disposed in unequal quantities.

5 Claims, 2 Drawing Sheets

STRUCTURE OF AUDIO SIGNAL CABLE

BACKGROUND OF THE INVENTION

1) Field of the Invention

The invention herein relates to high-fidelity sound system equipment and accessories, specifically an improved structure audio signal cable suitable for full frequency range (high, medium and low frequency) applications.

2) Description of the Prior Art

Signal transmission requirements have become higher because of the greater fidelity and sensitivity of currently available high fidelity audio system equipment. However, the signal cables utilized to convey alphanumeric pulse or audio frequency, alternating current signals involve transmission principles that are much more complex than that of direct current transmission. In addition to the resistance encountered by electricity flowing through the conductors and the generation of a magnetic field, there is skin effect occurring between high and low frequencies as well as phase distortion. To transmit a signal via a conductor at a balanced and total true-fidelity, acoustic frequency range (20 Hz to 20 kHz or wider), the design of the cable is extremely painstaking. Only this way can an amplified signal sound like the original when replayed through a loudspeaker.

Good signal cables should support fine dynamics, separation, and rich overtones as well as presence and musicality, but most importantly, it must have a very high degree of balance. Since balance is the most essential factor of high fidelity acoustics, when full-range balance is poor, this results in various problems. For example, insufficient bass makes people feel that music is muted and diluted. Conversely, when bass is excessive, sound becomes too dense and even burdensome. Sound becomes cold when midrange is lacking and overly warm when too much is heard. At the same time, overall definition is decreased, resulting in acoustic dispersion, sound alteration, and positional inaccuracy problems. When treble projection is inadequate, music becomes depressive, monotonous, and spatially confined, while the reverse situation results in a presentation that is too bright and lively. Interfacing robust cabling with other equipment involves a certain degree of difficulty; in conventional signal cables, skin effect is a challenging problem in that it is a common cause of distortion and adversely affects signal transmission.

SUMMARY OF THE INVENTION

Therefore, the primary objective of the invention herein is to provide a full frequency range, improved structure audio signal cable capable of solving the technological problems that would allow the output of different frequency band signals (i.e., treble, midrange, and bass), while also preventing phase differences.

To achieve the said objective, the invention herein utilizes the following technological means: The audio signal cable of the present invention is comprised of arrayed solid and tinsel wire conductors; after each of the conductors are insulated, they are placed into a surrounding insulation The solid conductors of the invention herein are of a circular and a flat, thin shape as well as differing larger and smaller diameters and, furthermore, disposed in unequal quantities.

The solid conductors of the invention herein are of differing larger diameters, wherein the diameter of the larger solid conductors is two to three times that of the smaller solid conductors.

In the audio signal cable of the invention herein, there are different diameter larger and smaller and, furthermore, circular and flat-, thin-shaped cables as well as tinsel wires disposed in unequal quantities that are covered to form cables, with filler elements disposed in the space between the cables and the insulation.

To compare the invention herein with the prior art, each cable is a structure consisting of a plurality of parallel, separate, and insulated conductors, wherein the cables thereof are thin and light, and most importantly have exceptionally low inductance and capacitance to convey tone color clearly and accurately. Furthermore, since high frequency signals are conveyed at faster speeds along metal surfaces and arrive first, while low frequency signals travel along the center of the conductors and arrive later, the smaller diameter tinsel wires are twisted to increase distance and enlarge their surface area to reduce skin effect for better high frequency transmission, with the larger diameter conductors enabling the rapid conveyance of low frequencies. As such, the present invention achieves the synchronous phasing of high and low frequency signals.

DETAILED DESCRIPTION OF THE INVENTION

First, the advantages of tinsel wire for amplified music broadcasting is explained. As is well known, for any conductor carrying an electric current, the electric current transmitted is affected by capacitance, inductance, and impedance inherent in the conductor itself. Such capacitance, inductance, and impedance inevitably causes phase shifts and frequency attenuation of the electrical signal, resulting in transmission losses. Moreover, high frequency signals and rich harmonic waves are easily dissipated by the low quality physical characteristics of the cable and insulative covering, noticeably reducing acoustic detail and timbre as well as other high fidelity components. To remedy such situations, in addition to improving the material quality of the cables and utilizing a relatively thin, flat material to achieve greater optimization within the bounds of practicality, the surface area of the conductor is enlarged to offset the skin effect that becomes more serious as the conductive efficiency of a conductor is raised. The best means of increasing conductor surface area is to utilize ultra-thin copper foil as the material; superior tinsel wire has a transmission impedance of only 2.5 ohms, which is approximately 1/50 that of a conventional rod-shaped material; as such, tinsel wire has low transmission impedance, meaning that it has even higher transient current conductivity, better transmission speed and load control capability, and a signal transmission phase shift of nearly zero, ensuring no signal phase shifting and noticeably enhancing sound position, focus, and separation.

Figure 1:
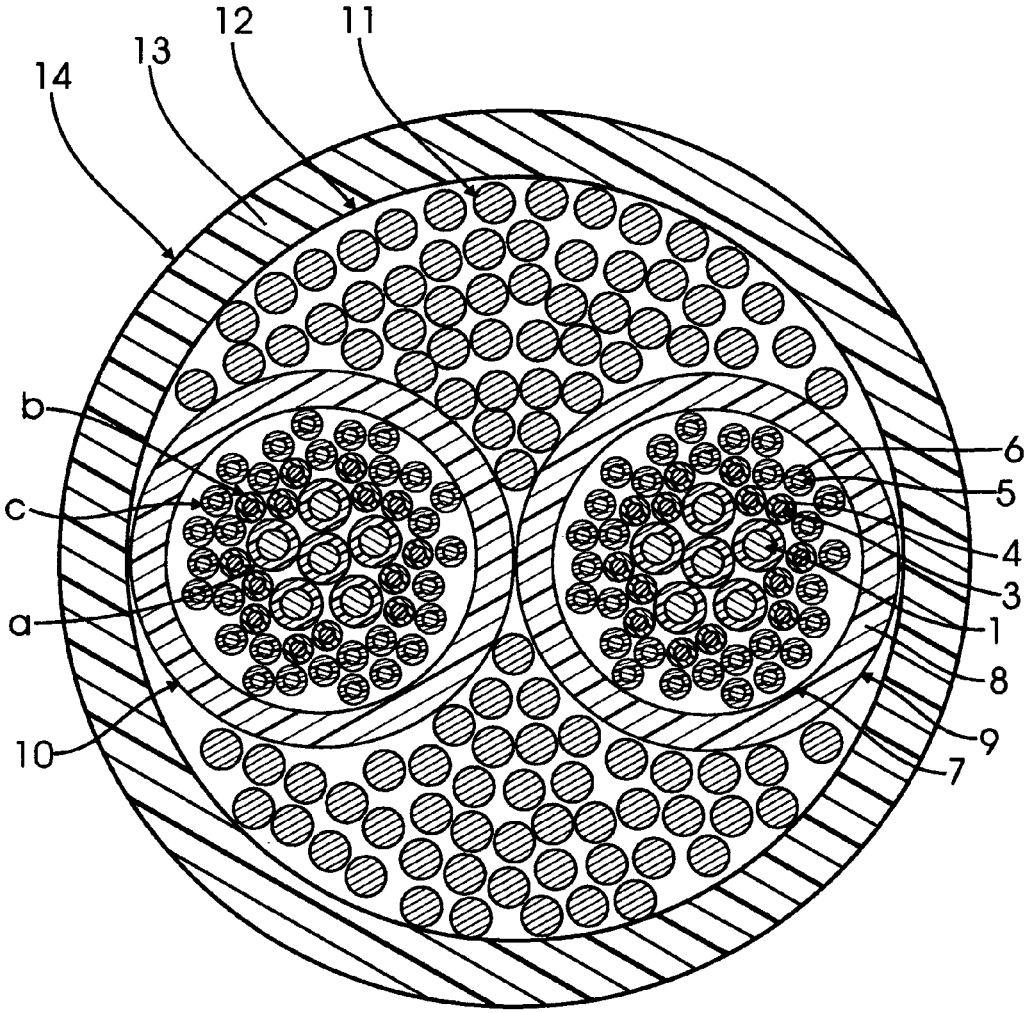
FIG. 1 is a cross-sectional drawing of the structure of the invention herein.

Referring to FIG. 1, larger solid conductors 1 and their insulation 2 comprise cable a, smaller solid conductors 3 and their insulation 4 comprise cable b, and tinsel wire 5 and their insulation 6 comprise cable c; after the cables a, b, and c of differing quantity and size are bundled into a multiple core conduit 7, an insulation 8 is placed around the outer extent of the multiple core conduit 7 to form a multiple core signal cable 9 and 10, filler elements 11 are disposed laterally along the multiple core signal cables 9 and 10 to form a multiple core composite cable 12, following which insulation 13 is placed around the multiple core composite cable 12 to complete the first embodiment cable 14 of the invention herein.

Figure 2:
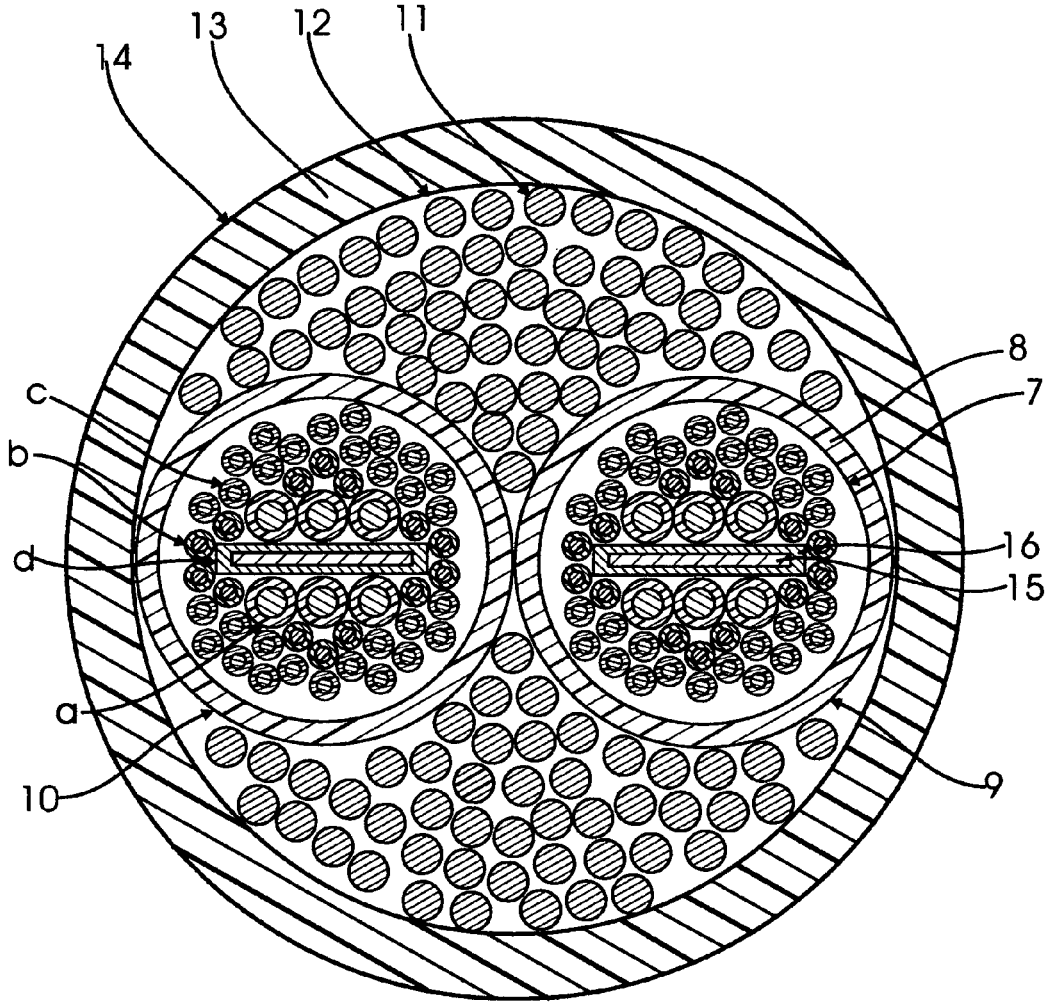
FIG. 2 is a cross-sectional drawing of another embodiment of the invention herein.

Referring to FIG. 2, the cross-sectional drawing of another embodiment of the invention herein, this variation is based on the first embodiment of the invention herein and additionally includes a thin, flat conductor 15 that is cross-sectionally rectangular which becomes a cable following the placement of insulation 16 around it; after the cables a, b, c, and d of differing quantity and size are bundled into a multiple core conduit 7, an insulation 8 is placed around the outer extent of the multiple core conduit 7 to form the multiple core signal cables 9 and 10, filler elements 11 are disposed laterally along the multiple core signal cables 9 and 10 to complete a multiple core composite cable 12, following which an insulation 13 placed around the multiple core composite cable 12 to complete the second embodiment cable 14 of the invention herein.

The said conductor refers to any conductive material; conductive wires are typically available in range of certain metals, but can be constructed of any suitable metallic material such as solid copper or multi-stranded copper wire, metal-based coatings containing silver, aluminum, iron, and other metals as well as alloys and other different formulations; the conductor can also be a non-metallic compound having conductive properties.

The said insulation, also known as a dielectric, refers to a material suitable for cable insulation such as polyethylene, polypropylene, fluoropolymer, cross-linked polyethylene, rubber, and other similar materials; many insulation materials also contain more than one type of additive such as a flame retardant agent and a mildew-proofing agent.

The said larger solid conductors 1 and smaller solid connectors 3 have physical diameters that are determined through actual testing; in the embodiments herein, the diameter of the larger solid conductors 1 is two times that of the smaller solid conductors 3.

The multiple core signal cables of the invention herein consists of a plurality of parallel, separate, and insulated conductors, wherein the cables are thin and light and most importantly have exceptionally low inductance and capacitance to convey tone color clearly and accurately. The acoustic characteristics of the thin, flat conductor include clarity, high definition, rich detail, tighter low frequency response, and enhanced livecabless; furthermore, the insulating of each conductor prevents interference between different conductors, thereby avoiding distortion losses in the original signal.

An audio signal cable constructed using varying combinations of multiple tinsel wire, flat solid conductors, and round solid core conductors of varying gauges with individual insulation. Unique invention is that these different conductor types handle specific frequency ranges differently and can be combined and optimized size, number and type for best performance in various audio applications. An unique cable type has been invented using combinations of these different conductor types. The tinsel wire is constructed with special core and dielectric materials for further optimization, and it minimizes sonic degradation caused by skin effect, thus yielding better high frequency performance. Because low frequencies are compromised with tinsel wire, solid bass conductors are used, thus balancing the frequency response. Flat conductors also handle midrange frequencies with greater accuracy, and these are used for this purpose. Specifically selected round conductor gauges are also used for the midrange to give proper balance between the bass and treble spectrums. Different gauge round conductors appear to emphasize particular frequency ranges, and can be selected to flatten frequency balance. The unique combination of tinsel wire and selected round and flat solid conductors gives better full range frequency balance and sound quality. The composite construction yields superior frequency balance and response accuracy than can be obtained by using constructions consisting of only one conductor type. The reasons for this are not clearly understood, but it appears that the different types of conductors are superior in certain frequency ranges. By combining conductors that each appear to be superior in the treble range, the bass range, and the midrange, a superior full range cable results. This construction is applicable to any type of audio signal.

While the said detailed description elaborates a workable embodiment of the improved structure of audio cable herein, the said embodiment shall not be construed as a limitation on the patented scope and claims of the present invention and, furthermore, all equivalent adaptations and modifications based on the technological spirit of the present invention shall remain protected within the scope and claims of the invention herein.

What is claimed is:

1. An audio signal cable comprising:

a signal multiple core conduit and a return multiple core conduit, the diameter of said signal conduit and said return conduit being equal;

said signal and said return multiple core conduits each containing individually insulated larger solid conductors, individually insulated smaller solid conductors, and individually insulated tinsel wires of distinct sizes;

insulation formed around said signal and return multiple core conduits;

filler elements disposed laterally along said signal and return multiple core conduits;

insulation formed around said filler elements; and wherein each of said individually insulated larger solid conductors, said smaller solid conductors and said tinsel wires is capable of conducting an electrical signal.

2. An audio signal cable of claim 1, wherein said larger solid conductors and said smaller solid conductors are cross-sectionally circular.

3. An audio signal cable of claim 1, wherein said larger solid conductors and said smaller solid conductors are cross-sectionally flat.

4. An audio signal cable of claim 2 and 3, wherein said larger solid conductors and said smaller solid conductors are of distinct, diameters and, furthermore, disposed in unequal quantities within said audio signal cable.

5. An audio signal cable of claim 4, wherein the diameter of said larger solid conductors is two to three times larger than the diameter of said smaller solid conductors.

* * * * *

UNITED STATES PATENT AND TRADEMARK OFFICE

CERTIFICATE OF CORRECTION

PATENT NO. : 6,969,805 B2
APPLICATION NO. : 10/619441
DATED : November 29, 2005
INVENTOR(S) : Jay Victor It is certified that error appears in the above-identified patent and that said Letters Patent is hereby corrected as shown below:

Title Page

Item 12 Lee et al. should read

Victor

Item 76 –should read Jay Victor
2017 Bataan Rd., Unit A
Redondo Beach, CA 90278

Signed and Sealed this

Ninth Day of December, 2008

JON W. DUDAS
*Director of the United States Patent and Trademark Office*